US006513670B2

(12) United States Patent
Minkkinen

(10) Patent No.: US 6,513,670 B2
(45) Date of Patent: Feb. 4, 2003

(54) DUAL USE CARGO CONTAINER

(76) Inventor: Erkki O. Minkkinen, P.O. Box 703, Westminster, MA (US) 01473

( * ) Notice: Subject to any disclaimer, the term of this patent is extended or adjusted under 35 U.S.C. 154(b) by 0 days.

(21) Appl. No.: 09/773,657

(22) Filed: Feb. 2, 2001

(65) Prior Publication Data

US 2002/0104838 A1 Aug. 8, 2002

(51) Int. Cl.[7] ..... B65D 88/10
(52) U.S. Cl. ..... 220/1.5
(58) Field of Search ..... 229/243, 233; 220/1.5, 4.03; 206/509, 511, 512

(56) References Cited

U.S. PATENT DOCUMENTS 3,814,301 A * 6/1974 Niepmann
4,396,143 A * 8/1983 Killy
5,413,224 A * 5/1995 Marron et al. ..... 206/511
5,601,201 A * 2/1997 Looker ..... 220/1.5
5,706,614 A * 1/1998 Wiley et al. ..... 52/537
5,735,639 A * 4/1998 Payne et al. ..... 220/1.5
5,813,536 A * 9/1998 Bartholomew ..... 206/511
5,966,956 A * 10/1999 Morris et al. ..... 52/69

* cited by examiner

*Primary Examiner*—Stephen Castellano
(74) *Attorney, Agent, or Firm*—A. David Pellinen

(57) ABSTRACT

Cargo containers are shipped to sites that have been subjected to severe damage. The containers, which may be stacked, contain food or other emergency goods. The containers have ramps at one or more sides to permit quick ingress and egress of the material. At the damage site the containers have knock outs removed and replaced by doors, windows and the like. In this manner the containers become dwellings suitable on an emergency basis as house, hospitals, mess halls, or other suitable dwellings.

4 Claims, 2 Drawing Sheets

DUAL USE CARGO CONTAINER

BACKGROUND OF THE INVENTION

1. Field of the Invention

This invention relates to the shipment of cargo. Once at their destination the cargo is unloaded and the now empty containers are converted and modified to become temporary emergency dwellings or quarters.

2. Background Art

The disposal of empty cargo containers are problems both in terms of cost and space. Some containers are designed so they may be reused. This requires them to be sent back to the place of origin, a costly procedure unless they have been filled with goods for the return trip. Others have to be destroyed because they take up space or because there is no further use for them.

In contrast to ordinary commercial use during emergencies many containers are never reused simply because the very nature of emergencies is such that it is necessary for goods and supplies are to be shipped and no thought is given for any further use of the containers.

SUMMARY OF THE INVENTION

The aftermath of natural calamities such as earthquakes, floods, hurricanes and other tragedies is filled with the need for food, housing, clothing and other goods. In such situations the containers of the present invention are used to ship food and other emergency goods as needed and when empty the containers are easily modified as temporary emergency dwellings or quarters. Thus the containers have a dual purpose, a container to ship goods and as a container converted into a house or other dwelling suitable for human habitation.

In areas of famine the primary use of the containers would be for food shipments. However military use is also contemplated since the containers can be modified for use as field hospitals, mess halls or quarters.

To these ends the containers are standardized to fit together with other containers. Together with prefabricated doors and windows accompanying the shipment the container or containers become a dwelling in a matter of minutes.

DETAILED DESCRIPTION OF THE INVENTION

Figure 1:
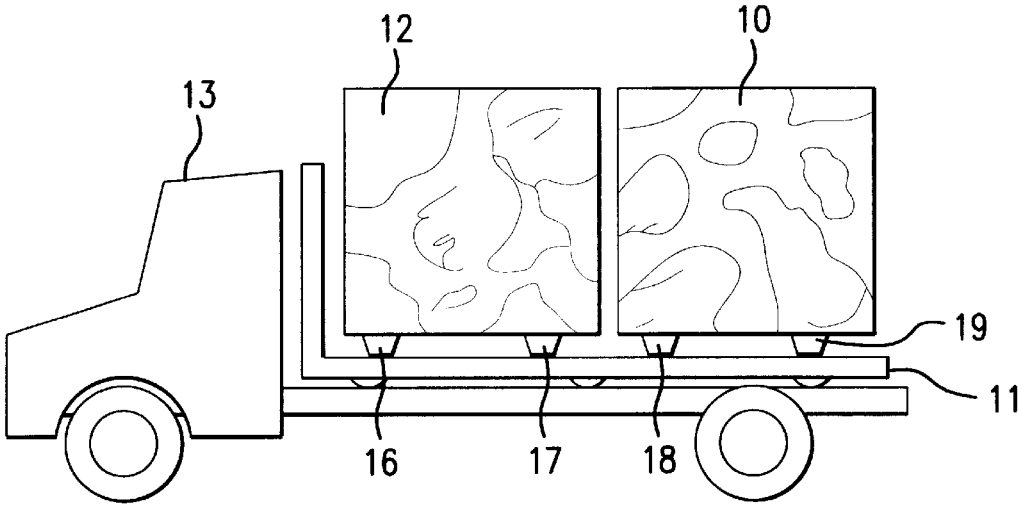
FIG. 1 shows two of the inventive containers carried on a truck.

FIG. 1 shows rectangular containers 10 and 12 mounted on a ramp or slider 11 which is carried on truck 13. The truck may be open, as shown, or enclosed. The shading on the containers represents camouflage which would be on all sides and the top. The camouflage is indicative of the possible application of the containers to military use. The containers could instead have red crosses emblazoned on their sides and tops when used as an emergency field hospitals.

The containers can be delivered by truck to a suitable location where any suitable ramp can be hinged or otherwise tilted and the containers slid off the ramp. The two containers depicted in FIG. 1 may be cubes measuring 8'×8'×8'. The drawings are not to scale and the truck may accommodate more than two containers or there may be a single container. The containers are preferably built in multiples of eight feet but any unit of measurement including the metric system can be used for standardization purposes. The term multiple includes units like 8'×8'×8', 8'×8'×16', 8'×8'×24', the point being that an established standard could be a multiple of any unit length. The adoption of a standard would permit construction anywhere in the world and easy mating of container to container.

During transit skids 16–19 engage recesses or indentations in the ramp 11. Of course any other mechanism can be used to render the containers immovable during transit. As an alternative to motorized transport, the containers could be air dropped or otherwise delivered to an area of use. The containers can be made of lightweight fiberglass making them suitable for delivery by aircraft.

Figure 2:
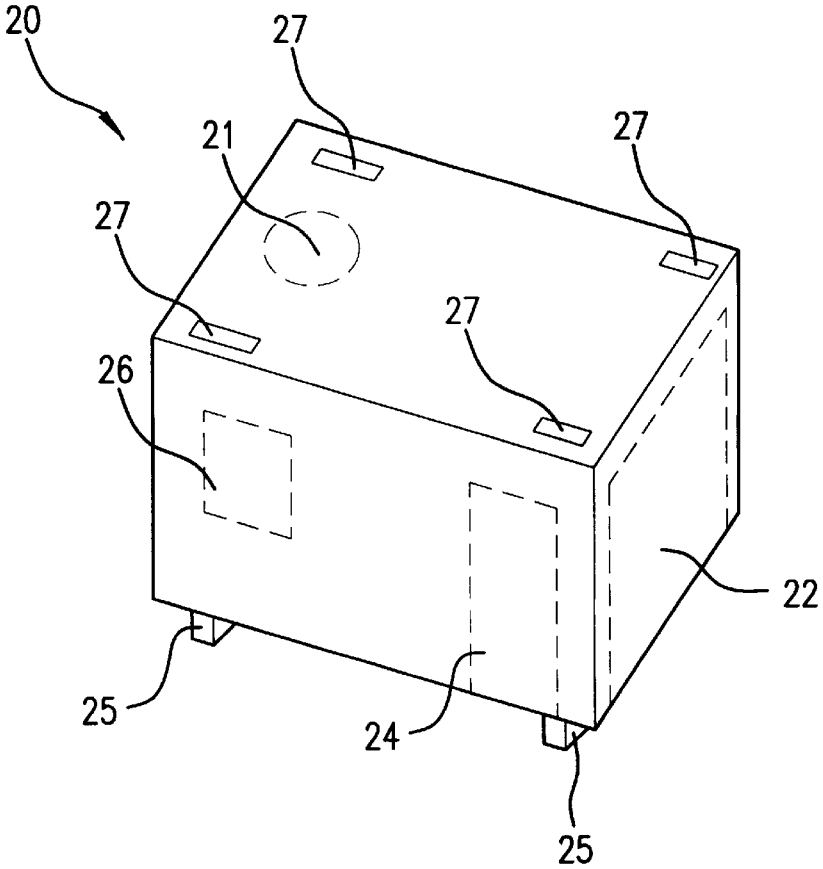
FIG. 2 is a perspective view of a single container.

FIG. 2 shows a perspective view of a rectangular container 20. The use of fiberglass permits the sides and floor to be glued together with epoxy. In dashed lines are shown some possible knock outs. Knock outs serve as a ready made way to establish windows, doors or other openings commonly found in dwellings or shelters. The window cutouts may be 2 feet by 2 feet, or 2 feet or 4 feet at any desired height from the floor and corners, the door cutouts may be 2 feet by 6 feet. Clearly the size of the cutouts are subject to design and choice. The door cutouts may be covered from the inside by a single layered fiberglass panel slightly larger than the cutout and lightly glued to facilitate knockout of an empty container from the outside. The doors and windows, when used, may be separately packaged, each neoprene gasketed, pressed into the cutout and held there by metal clamps. Hinges may also be used as appropriate for doors and/or ramps.

The container 20 includes a loading ramp 22 which may be at any side of the container 20. Loading ramp 22 may be hinged into a down position and to permit the container to be loaded or equipped with suitable items and then restored to an upright position during transit. During emergency use the containers may be loaded with for example, food, clothing or medical supplies.

At 24 a knock out serves as a door opening while another knock out 26 provides a window opening. At the top of the container 20 is a chimney knockout 21. Skids such as 25 are designed to fit into a stacking relationship with another container having similar recesses or indentations 27. Thus one container can rest securely upon another like container recess. These skids and indentations permit stacking of one container upon another during storage or shipping. The skids 25 are also designed to fit into or engage recesses or indentations in the ramp 11 shown in FIG. 1. Again, standardization affords easy accommodation of container to container. The walls may be of fiberglass so that the container becomes an insulated house.

The doors, windows and ramps may be at any part of a container. A ramp may be at the middle of a side or at an end of the container. It also would be desirable to have breather caps, such as two inch diameter caps, pressed inside each wall, at intervals, such as two feet, to prevent damage to the container by accidental de-pressurization when carried onboard an aircraft.

Figure 3:
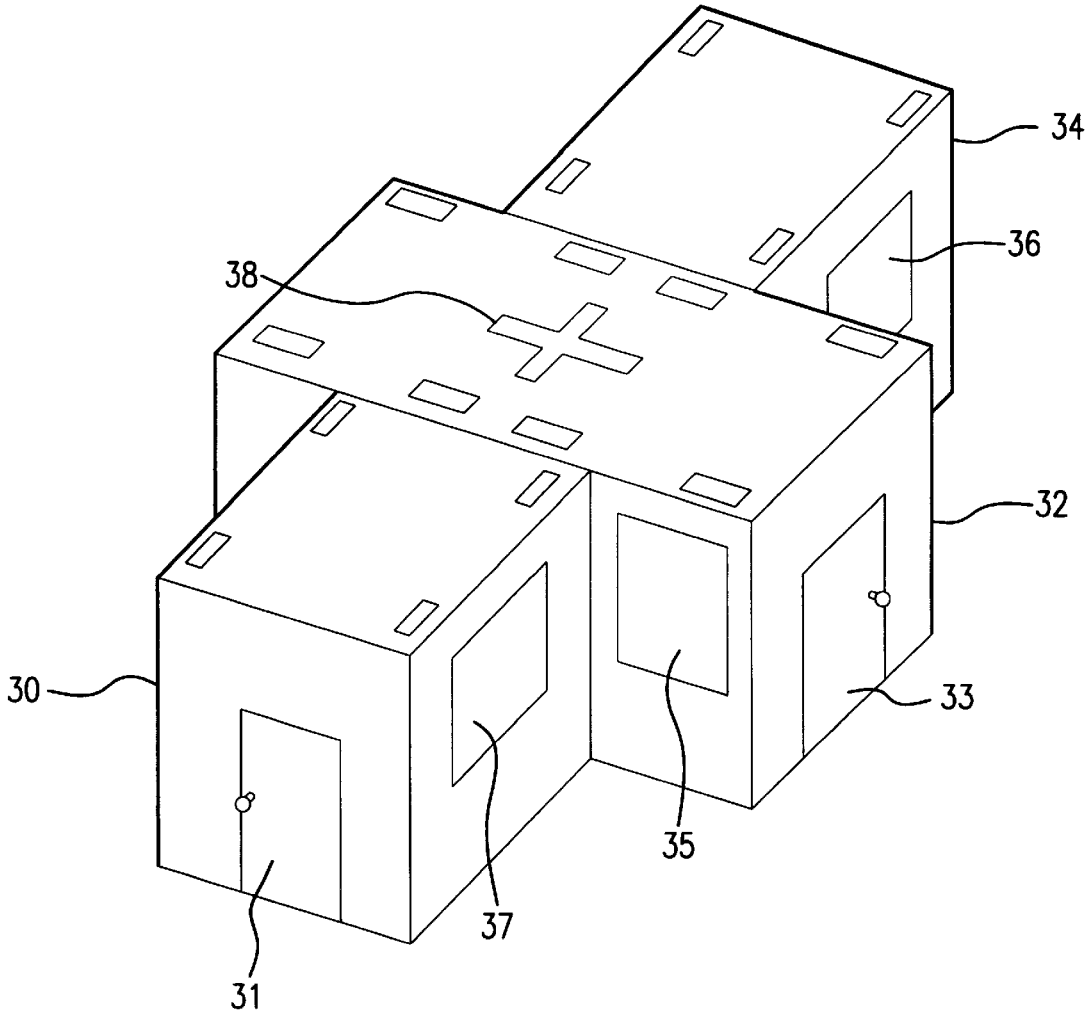
FIG. 3 is a perspective view of three containers joined together.

FIG. 3 shows three containers 30, 32, 34 mated together as an emergency field hospital with a cross 38 or crosses symbolizing the medical function of the dwelling. Container 30 has a door 31 and window 37; container 32 has door a door 33 and a window 35; and container 24 has a window 36.

In operation, the containers 30, 32 and 34, having knock outs of any appropriate number and configuration, are filled with goods, medical supplies, equipment, or whatever the nature of the situation requires. At a loading facility the ramps of the FIG. 2 type are used for loading. During shipment the ramps and knock outs remain in place. The containers may be air dropped or otherwise delivered to site of use. At the site the containers may be emptied of their contents by way of the ramps and or door openings whereby the food or other supplies to be given away or otherwise utilized. Of course, the containers may contain medical equipment intended to remain in the container. The containers may then be put into mating engagement as shown, for example in FIG. 3, to be used as a shelter, field hospital, or other dwelling.

Some of the knock outs on the containers may be in congruent relationship to other knock outs to permit easy access and mobility for people between containers, or as they now function, as rooms. Thus the ramps may be totally removed to permit ready access between containers 30 and 32 at the middle of container 32. Similarly the container 34 may have a ramp for loading it, which ramp may be removed to permit access to container 32 at the opposite middle part of the container 32. The containers have doors, windows and other items to be put into place. The door and window knock outs are removed and appropriate windows and doors put into place.

The dual use of the containers is now readily apparent. When there is an emergency such as an earthquake, flood, hurricane or other tragedy the containers may be loaded with appropriate goods. Entry into the containers is by way of the doors and/or ramps. The doors and ramps are suitably closed or attached and the cutouts or knock outs are in place during delivery.

Thus the knock outs are movable to permit entry into and out of a container and movable to a closed position during the delivery phase and movable to an open position while in use as a door or ramp. A knock out can be totally removed so that when mated with another container it is easy to move such as going from room to room.

The containers could have been in a supply depot or the like where they have already been loaded or equipped with appropriate goods. In any event, the containers are then loaded onto trucks, ships or aircraft, depending of course on where the emergency has occurred. This first use is that of delivery of goods and material.

After delivery the appropriate doors, windows, ramps etc. are put into their intended positions and the contents unloaded or a field hospital set up as needed. Emergency goods may be distributed and then the interior may be set up as a field hospital, shelter or whatever the emergency dictates. Power may be supplied to the shelter if possible by standard standby or emergency power supplies. Water, if available, may be supplied to pipes that may be part of the container as shipped or as an add on. This second use is as a shelter, emergency room, or field hospital.

Figure 4:
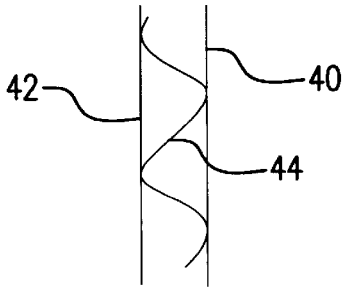
FIG. 4 is a side view of a container wall.

FIG. 4 is a side view of the container walls. Inner and outer fiberglass walls 40, 42 containing between them a ribbon of fiberglass reinforcement. The walls shown are lightweight, fireproof but other suitable materials can be used.

I claim:

1. A container having dual uses comprising:

a housing with walls, a roof and a floor;

said walls having openings therein;

a plurality of panels slightly larger than said openings and covering said openings from the inside of said housing thereby permitting said container to be sealed after being loaded with both goods and prefabricated doors and windows to be stored and shipped within said container during a first use of said dual uses, and said container being adaptable for a second use wherein said plurality of panels are removable, said prefabricated doors and windows are adaptable to be placed over said openings, whereby in said second use said goods are unloadable and said container is suitable for human habitation.

2. The container of claim 1, wherein one of said walls has a ramp to provide access to said container.

3. A plurality of containers each having dual uses:

each of said containers comprising:

a housing with walls, a roof and a floor;

said walls having openings therein;

a plurality of panels slightly larger than said openings and covering said openings from the inside of said housing thereby permitting said container to be sealed after being loaded with both goods and prefabricated doors and windows to be stored and shipped within said container during a first use of said dual uses, said container being adaptable for a second use wherein said plurality of panels are removable, said prefabricated doors and windows are adaptable to be placed over said openings, and at least one of said openings of one of said containers being adapted to have a congruent relationship to at least one of said openings in a second of said containers to permit during a second use of said dual uses access between said containers, whereby in said second use said containers are suitable for human habitation.

4. The container of claim 3 wherein at least one of said walls has a ramp to provide access to said container.

* * * * *